US008448593B2

(12) United States Patent
Kopylov

(10) Patent No.: US 8,448,593 B2
(45) Date of Patent: May 28, 2013

(54) FOLDING BOAT

(75) Inventor: Eduard Kopylov, Aurora, CO (US)

(73) Assignee: Eduard Kopylou, Aurora, CO (US)

( * ) Notice: Subject to any disclaimer, the term of this patent is extended or adjusted under 35 U.S.C. 154(b) by 0 days.

(21) Appl. No.: 12/924,152

(22) Filed: Sep. 15, 2009

(65) Prior Publication Data

US 2011/0061585 A1 Mar. 17, 2011

(51) Int. Cl.
*B63C 13/00* (2006.01)
*B63B 7/00* (2006.01)
*B63B 17/00* (2006.01)

(52) U.S. Cl.
USPC ..... 114/344; 114/353; 114/362; 280/414.2

(58) Field of Classification Search
USPC ..... 114/352, 362, 344, 353; 280/414.1, 280/414.2
See application file for complete search history.

(56) References Cited

U.S. PATENT DOCUMENTS 2,565,369 A * 8/1951 Hamilton ..... 114/266
3,042,942 A 7/1962 Howe
3,090,973 A * 5/1963 Levinson ..... 114/344
3,584,704 A * 6/1971 Eckmann ..... 182/90
3,683,840 A * 8/1972 Russell ..... 440/12.7
3,968,532 A 7/1976 Bailey
4,327,933 A * 5/1982 Tuggle ..... 280/414.2
4,432,436 A * 2/1984 Suiter ..... 182/97
4,736,702 A * 4/1988 Gubin ..... 114/353
4,768,456 A * 9/1988 Jones et al. ..... 114/266
4,800,832 A * 1/1989 Sulimierski ..... 114/352
4,823,717 A * 4/1989 Roberson ..... 114/61.1
4,829,926 A * 5/1989 Voelkel ..... 114/61.22
4,856,446 A 8/1989 Herard
4,887,654 A * 12/1989 Rytand ..... 114/267
4,940,021 A * 7/1990 Rytand ..... 114/267
5,014,640 A * 5/1991 Owen, Sr. ..... 114/362
5,052,324 A * 10/1991 Lesly ..... 114/353
5,183,002 A * 2/1993 Parker ..... 114/353
5,199,371 A * 4/1993 Meriwether ..... 114/267
5,353,733 A * 10/1994 Evans ..... 114/353
5,450,809 A * 9/1995 Melton ..... 114/353
5,524,570 A * 6/1996 Kaye ..... 114/353
5,597,277 A * 1/1997 Mayfield ..... 441/130
5,803,007 A * 9/1998 Stevens ..... 114/266
5,870,966 A * 2/1999 Christian ..... 114/353
6,345,581 B2 * 2/2002 Blanchard ..... 114/61.1
6,755,142 B2 6/2004 Rice
6,766,758 B1 * 7/2004 Zoss et al. ..... 114/353
6,851,382 B2 * 2/2005 Carter ..... 114/344
6,860,221 B1 * 3/2005 Henderson ..... 114/352
6,860,223 B2 * 3/2005 Lee et al. ..... 114/364
6,948,443 B1 * 9/2005 Kopylov ..... 114/353

(Continued)

*Primary Examiner* — Lars A Olson
*Assistant Examiner* — Andrew Polay

(57) ABSTRACT

A folding boat with at least two foldable horizontal frames each comprising at least two foldably connected sections a frame. Said sections comprise two longitudinal rails connected by a plurality of transverse members and at least one swivelly foldable guard rail with releasable locking means. Said longitudinal rails comprise internal and external longitudinal groves, where said internal longitudinal grooves hold a plurality of removable and stackable floats. Said floats can be equipped with at least two fins attached to the bottom of said floats for attachment of boat launching wheels. One of said horizontal transverse has two front guard rails equipped with a guiding channels supporting a slideable frame of climbing step, where said frame is slideably movable between an upper retracted position acting as a guide rail and said frame being moved to lower position provides convenient position of the climbing step.

5 Claims, 12 Drawing Sheets

U.S. PATENT DOCUMENTS

| | | | | |
|---|---|---|---|---|
| 6,948,588 | B1 * | 9/2005 | Chustak | 182/97 |
| 7,021,228 | B2 * | 4/2006 | Robb | 114/26 |
| 7,096,817 | B1 * | 8/2006 | Scadden | 114/363 |
| 7,296,816 | B2 * | 11/2007 | Wilnau | 280/414.2 |
| 7,475,652 | B2 * | 1/2009 | Dvorak | 114/362 |
| 7,513,210 | B1 * | 4/2009 | Salit et al. | 114/352 |
| 7,644,677 | B2 * | 1/2010 | Nakano | 114/362 |
| 2006/0180071 | A1 * | 8/2006 | Blank | 114/362 |
| 2006/0243183 | A1 * | 11/2006 | Eveleth | 114/102.1 |
| 2007/0186840 | A1 * | 8/2007 | Dvorak | 114/362 |
| 2007/0295264 | A1 * | 12/2007 | Fishburn | 114/364 |
| 2009/0013919 | A1 * | 1/2009 | Boos, Jr. | 114/321 |

* cited by examiner

FOLDING BOAT

CROSS-REFERENCE TO RELATED APPLICATIONS

This application claims the benefit of U.S. Pat. No. 6,948,443 filed 2005 Jan. 26 by the present inventor.

FEDERALLY SPONSORED RESEARCH

Not Applicable

SEQUENCE LISTING OF PROGRAM

Not Applicable

BACKGROUND OF INVENTION

1. Field of Invention

This invention relates to boats and more particular, to folding boats.

There are several types of folding boats on the market: rigid structure type, inflatable type and combination of both types mentioned above.

Inflatable boats depend upon ability to maintain air pressure and are extremely vulnerable to puncture.

Rigid structure boats offer significant advantages in terms of comfort, reliability and stability, however, existing rigid structure folding boats are too heavy to handle in folding and unfolding process and are not sufficiently compact and versatile in their folded configuration. They do not offer sufficient flotation redundancy or construction integrity. They often require a trailer for their transportation or, at the best, a track bed or luggage rack on a vehicle. It is understood that there is a real demand for a compactly folding boat combining advantages of a rigid structure, flotation redundancy, simplicity and lightness in folding and unfolding process, compactness and versatility in folded configuration. There is need for a folding boat requiring small storage area with ability to be transported in a station wagon, in a minivan or in a sport-utility vehicle.

2. Prior Art

The folding boat offered by Strausser in U.S. Pat. No. 3,056,147 comprises a foldable lengthwise hull with two large seams which are prone to leaking. In addition to that, the boat lacks any redundant flotation mean full hull length in the folded configuration creates difficulties of storage and transportation.

The portable, foldable and collapsible water cycle disclosed by Liard in U.S. Pat. No. 3,257,987 can be folded along the longitudinal axis of the hull creating long package which would be difficult to transport or store.

The pontoon boat having a collapsible form presented by Voelkel in U.S. Pat. No. 4,829,926 comprises two full length pontoons with collapsible structure on a top of them. Full length pontoons are bulky and take too much space, even in the folded configuration.

The folding fishing boat apparatus disclosed by Lesly in U.S. Pat. No. 5,052,324 comprises two full length pontoons which are not allowing compactly folded configuration.

The portable pontoon boat presented by Evans in U.S. Pat. No. 5,237,954 comprises four pontoons and removable structure above them.

Such arrangement presents some improvements, however, bolted half shells construction of the pontoons are prone to leaking and require complex assembly and disassembly process.

The modular pontoon deck disclosed by Stevens in U.S. Pat. No. 5,803,007 comprises plurality of modular floats connected to a modular achieve compact folding, however, it is too complicated and plurality of the modular floats still would occupy too much space in folded configuration, so it would be difficult to transport a such boat in a station wagon, minivan or sport-utility vehicle.

The collapsible trailerless pontoon boat offered by Little in U.S. Pat. No. 6,067,925 comprises four pontoons and foldable platform.

This idea failed to provide compact folded configuration due to the bulky pontoons.

In addition to that, the system is too complicated and expensive to manufacture.

The collapsible boat transport system offered by Brignolio in U.S. Pat. No. 6,647,913 is three full length pontoon configuration with folding ability to reduce distance between pontoons. This is bulky boat suggested for trailer transportation with very modest reduction of size in folded configuration.

The folding boat disclosed by Zoss et al. in U.S. Pat. No. 6,766,758 comprises four pontoons and pivotally folded deck panels.

Such folding arrangement does not produce compact folding configuration suitable for transportation in medium size vehicles. In addition to that, this boat is too bulky to handle it by a one person.

OBJECTS AND ADVANTAGES

Accordingly, besides the objects and advantages of the folding boat described in my Patent several objects and advantages of the present invention are:

a. To provide a rigid structure folding boat which being in folded configuration would feet inside of most medium size station wagons, minivans, sport-utility vehicles and would be easy to store indoors.

b. To provide a folding boat which would have simple and quick assembly and disassembly process without tools, loading and unloading by a one person.

c. To provide a folding boat with reliable and redundant flotation capabilities.

d. To provide a folding boat which would be easy and inexpensive to manufacture.

e. To provide a folding rigid structure boat where some elements of it could be utilized for other than flotation purposes.

f. To provide a folding boat which would easily used with muscular, wind or solar-electric propulsion systems.

g. To improve hydrodynamic quality and rigidity of pontoons.

SUMMARY

The apparatus of the present invention overcomes the above-mentioned disadvantages and drawbacks that are characteristic of these aforementioned designs. More particularly, a preferred embodiment of the present invention comprises a foldable boat apparatus that is easy to assembly into operational mode, easy to transport and to store.

In a preferred embodiment, the folding boat comprises at least two foldable horizontal frames each comprising at least two fold ably connected sections with longitudinal rails equipped with internal and external longitudinal grooves.

Said longitudinal rails are interconnected by a plurality of transverse members of said foldable horizontal frame.

Said fold ably connected sections of each said foldable horizontal frame can be attached to each other by a transverse swivel joint on one side of said foldable horizontal frame and by releasable locking means on another side of the same foldable horizontal frame.

Also, said fold ably connected sections of the same foldable horizontal frame can be attached to each other by said releasable locking means on each side of said foldable horizontal frame.

A plurality of removable horizontal transverse beams connect said foldable horizontal frames of the boat in unfolded configuration.

Said removable horizontal transverse beams can be engaged with said horizontal transverse members of each said foldable horizontal frame structurally connecting both said frames.

Releasable locking means installed on each said transverse member can hold both ends of said horizontal transverse beams in engaged position.

Said horizontal transverse beams are equipped with longitudinal tabs.

A plurality of deck sheets can be supported and held by said external grooves of said longitudinal rails and supported by said longitudinal tabs of said removable horizontal transverse beams.

Each said foldable horizontal frame hold plurality of removable and stackable floats.

Each said float comprises a removable and stackable gasketted watertight cover. Said gasketted covers can be equipped with at least one removable gasketted water-tight access hatch.

Each said above float can be equipped with horizontal longitudinal tabs which can be engaged with said internal longitudinal grooves of said longitudinal rails.

Said floats covers can be attached to the said float by a releasable locking means or can be extended to the vertical longitudinal walls of said float tabs to be held by said internal longitudinal grooves of longitudinal rails.

Said floats can be three styles of configurations: for individual installation for paired installation, or combination of intermediate and end floats forming a continuous pontoon hull.

Regardless of the float style the float configuration consists of two distinctive parts divided by a transition line at which both parts meet, a lower part designed to be normally in contact with water and upper part designed to be normally above water.

Each float designed for paired installation comprises flat vertical wall which allows to install them in a mirror orientation with their vertical walls contacting each other, so, said pair of floats forms at least one pontoon hull.

One type of combination of floats designed to form continuous pontoon hull can comprise one intermediate symmetrical float and two end style floats, another type of such combination can comprise two intermediate asymmetrical floats and two end style floats.

Regardless of float shape the floats can be designed with one common shape and size cover to fit all floats of a specific float combination mentioned above.

Said floats can be equipped with a removable stiffening element installed inside lower part of said floats to prevent deformation of said floats by pressure of water.

Said floats can be equipped with at least two fins attached to the bottom of said floats for better protection from physical damage and for releasable attachment of boat launching wheels.

Said removable horizontal transverse beams located at the front or at the rear of the boat can be equipped with a transom plate.

Said folding boat can be used with muscular, wind and solar-electric propulsion.

In the folding process of the inventive boat the releasable locking means of the removable transverse beams to be released and said removable transverse beam moved out of said transverse members of foldable horizontal frame allowing to lift said removable deck sheets out of the boat. Further, said removable transverse beams, being fully disengaged from said transverse members, leaving said foldable horizontal frames with mounted said floats. Then, releasable locking means of said foldable horizontal frame being released allow said floats to be removed from the frame by sliding them out of the internal longitudinal grooves of the longitudinal rails being positioned for removal of the floats.

Swivelly foldable guard rails mounted on said foldable horizontal frames can be swivelly folded with prior release of guard rail releasable locking means.

In the folded configuration the guard rails would assume a position substantially coplanar with the top surface of said foldable horizontal frame.

A slide able climbing step frame with two guiding channels of front guard rails attached to the front horizontal transverse beam of the boat can provide easy access to the boat deck, where said step frame can assume upper retracted position when said step frame is locked in this position by step frame releasable locking means and, upon release of said locking means, sad step frame can slide down to form a climbing step.

The covers of said floats to be removed and stacked allowing the floats to be stacked in compact stack.

At the end of the folding process the inventive boat to be reduced to the compact stack of the floats, stack of the float covers, stack of the deck sheets, the folded horizontal frames and detached said horizontal transverse beams.

To insure the boat redundant flotation following elements of the inventive boat can be equipped with plastic foam fillings or air pockets. Such elements of boat structure like longitudinal rails, transverse members foldable horizontal frames, removable horizontal transverse beams, transom plate, guard rails, slide able climbing step frame can be filled by plastic foam. Removable deck sheets can be constructed of light composite material with foam or air pocket cells. The boat floats can be equipped with plastic foam material attached to the bottom wall and covers of said floats.

At least two pairs of removable wheels with axle can be attached to the boat floats to allow easy launching of the boat.

Some elements of the folded boat can be utilized for the purposes different from flotation. For instance, the floats can be used as storage bins, the foldable horizontal frame and the deck sheets can be utilized as structural elements for variety of different useful purposes.

Also, substantially rectangular plan view configuration of said foldable horizontal frames of the inventive boat allow to connect a plurality of such boats to each other in a horizontal longitudinal direction to form larger floating platform.

DRAWINGS

Figures

Drawings FIG. 1 through FIG. 10 are referred to U.S. Pat. No. 6,948,443 filed 2005 Jan. 26 by the present inventor.

New Drawings

REFERENCE NUMERALS

Figure 1:
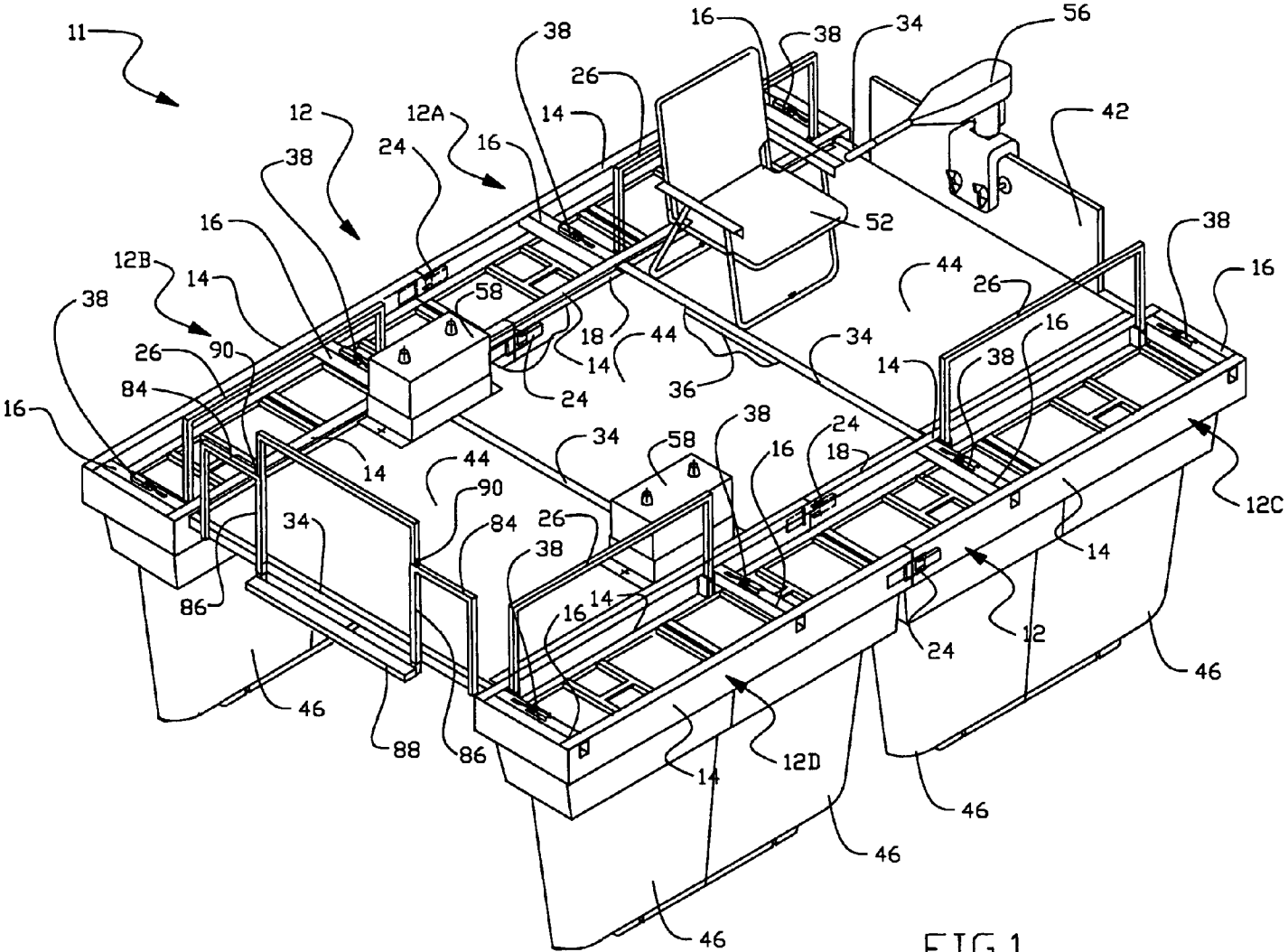
FIG. 1 Shows isometric view of the inventive boat with two pairs of floats on each side and climbing step frame in retracted upper position.

| | | | |
|---|---|---|---|
| 11 | Inventive folding boat frame section | | |
| 12 | Foldable horizontal frame | 12A | Foldable horizontal frame section |
| 12B | Foldable horizontal frame section | 12C | Foldable horizontal frame section |
| 12D | Foldable horizontal frame section | 14 | Longitudinal rail of the foldable horizontal frame |
| 16 | Transverse member of the foldable horizontal frame | 18 | External longitudinal groove of the longitudinal rail |
| 20 | Internal longitudinal groove of the longitudinal rail | 22 | Transverse swivel joint of the foldable horizontal frame |
| 24 | Releasable locking means of the foldable horizontal frame | 26 | Swivelly foldable guard rail |
| 28 | Holding bracket of the guard rail | 30 | Transverse swivel joint of guard rail |
| 32 | Releasable locking means of the guard rail | 34 | Removable horizontal transverse beam |
| 36 | Longitudinal tab of the horizontal transverse beam | 38 | Releasable locking means of the horizontal transverse beam |
| 40 | Transverse beam keyhole for the releasable locking means | 42 | Transom plate |
| 44 | Removable deck sheet | 46 | Removable and stackable float |
| 48 | Removable and stackable gasketted cover of the float | 50 | Horizontal longitudinal tab of the float |
| 52 | Folding armchair | 54 | Releasable locking means of the armchair |
| 56 | Removable electric trolling motor | 58 | Rechargeable electric battery |
| 60 | Removable holding tray for the battery | 62 | Releasable locking means for the battery holding tray |
| 64 | Removable photovoltaic array solar panel | 66 | Releasable locking means for the solar |
| 68 | Removable and stackable float individually mounted style | 70 | Removable wheeled shoe for launching the boat |
| 72 | Float bottom middle fin | 74 | Float bottom side fin |
| 76 | Notch to hold boat launching wheels axle | 78 | Boat launching wheels with axle |
| 80 | Float stiffening element | 82 | Stiffening element support key |
| 84 | Front guard rail | 86 | Guiding channel of front guard rail |

-continued

| | | | |
|---|---|---|---|
| 88 | Slideale frame of climbing step | 90 | Step frame releasable locking means |
| 92 | Removable and stackable intermediate symmetrical style float | 94 | Removable and stackable end style float |
| 96 | Removable and stackable intermediate asymmetrical style float | 98 | Float cover gasketted watertight access hatch |
| 98 | Access hatch releasable locking means | 102 | Plastic foam for redundant floatation |

DETAILED DISCLOSURE OF PREFERRED EMBODIMENTS

Although, specific features of the invention are shown in some drawings and not others, this is for convenience only as each feature may be combined with any or all of other features in accordance with the invention.

While preferred illustrative embodiments of the invention are described above, it will be apparent to those skilled in the art that various changes and modifications may be made without departing from the invention.

The appended claims are intended to cover all changes within the spirit of the invention.

A preferred embodiment of the inventive folding boat is illustrated in FIGS. 19-29.

Referring now to FIG. 1, which is an isometric view of the inventive boat (11) in unfolded configuration. The boat comprises at least two foldable horizontal frames (12) with at least two fold ably connected sections (12A),12B in one said frame (12) and with at least two fold ably connected section (12C), (12C) in another said frame (12). Each said section of said foldable horizontal frames consist of two parallel longitudinal rails (14) which are interconnected by transverse members (16).

Said fold ably connected sections (12A) and (12B) of said one foldable horizontal frame are attached to each other by releasable locking means (24).

Said fold ably connected sections (12C) and (12D) of said another foldable horizontal frame are attached to each other by the same type of locking means (24).

As can be seen on the drawing said longitudinal rails (14) of each foldable horizontal frame (12) are connected by releasable locking means (24).

Said releasable locking means (24) being of the usual conventional design, old in the art, and well known in structure and methods of operation to those skilled in the art, they are therefore simply indicated, and the details of structure and operation of them are omitted.

At least one swivelly foldable guard rail (26) is mounted on each said fold ably connected section (12A), (12B), (12C), (12D) of said foldable horizontal frame (12).

Removable horizontal transverse beams (34) connect said foldable horizontal frames (12) of the boat (11) engaging respective said transverse members (16).

Transverse beam releasable locking means (38) being installed on said transverse members (16) holds said transverse member (16) and said horizontal transverse beam (34) in engaged position.

Said releasable locking means (38) being of the usual conventional design, old in the art, and well known in structure and methods of operation to those skilled in the art, it is therefore simply indicated, and the details of structure and operation of it are omitted.

A transom plate (42) can be attached to said horizontal transverse beam (34) at the front or at the rear of the boat.

Two opposite edges of removable deck sheets (44) are supported by longitudinal tabs (36) of said horizontal transverse beams (34) and other two edges are engaged and supported by external longitudinal grooves (18) of said inner longitudinal rails (14).

A plurality of removable and stackable floats (46) are release ably attached to said foldable horizontal frames (12). Said floats (46) are installed in pairs in mirror orientation with their vertical flat walls contacting each other, so, said pair of floats forms one hull.

The drawing shows a front guard rails (84) with guiding channels (86) being attached to the boat removable horizontal transverse beam (34) support a slide able frame of the climbing step (88) which is shown in retracted upper position being held in this position by step frame releasable locking means (90).

The step frame releasable locking means (90) being of the usual conventional design, old in the art, and well known in structure and methods of operation to those skilled in the art, it is therefore simply indicated, and the details of structure and operation of it are omitted.

Figure 2:
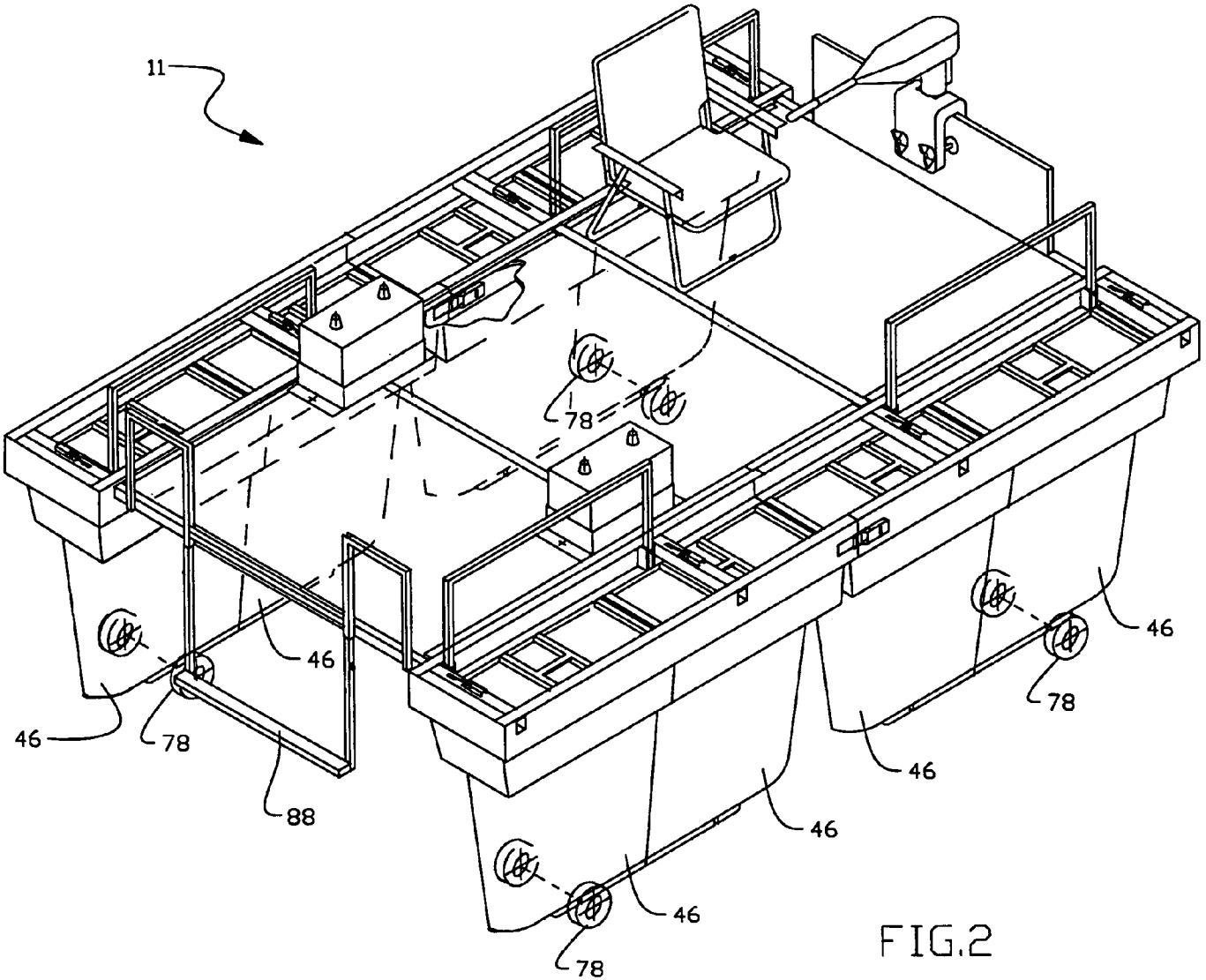
FIG. 2 Shows isometric view of the inventive boat with attached removable launching wheels and climbing step frame in lower position.

Referring to FIG. 2 which is an isometric view of the inventive boat of the same configuration, in addition, equipped with four boat launching wheels 78 with axles. Described above the slide able frame of climbing step (88) is shown in the down position offering convenient access to the boat deck level. The drawing shows four boat launching wheels with axles being remove ably-attached to the boat floats (46).

Figure 3A:
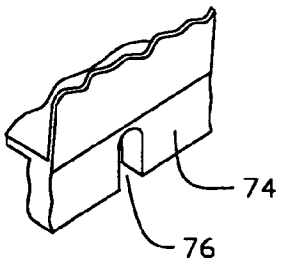
FIG. 3A Shows isometric detail view of a straight shape notch to hold boat launching wheels axle.
Figure 3B:
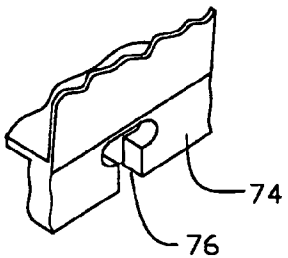
FIG. 3B Shows isometric detail view of a T-shape notch to hold boat launching wheels axle.
Figure 3:
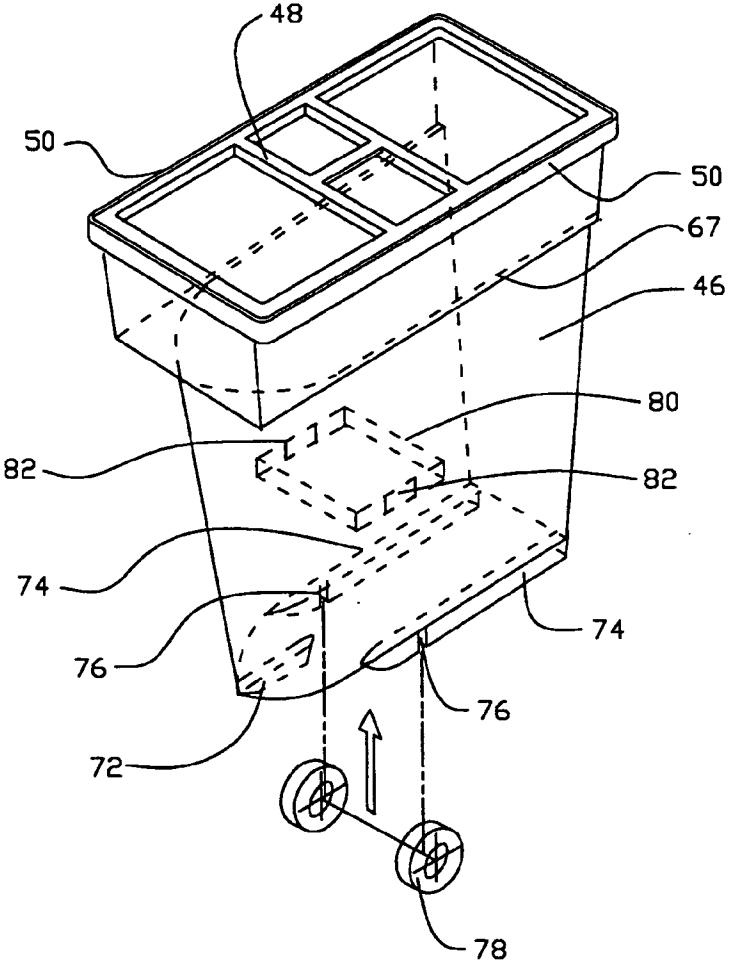
FIG. 3 Shows isometric view of paired installation type float with installed cover, stiffening element and provision for boat launching wheels.

Referring to FIG. 3, which is an isometric view, preferred embodiment of the removable and stackable float (46) with lifted up a removable and stackable gasketted cover (48). As can be seen, rear wall of the float (46) is substantially flat and vertical and can be utilized in paired installation as mentioned in the description of FIG. 1. Horizontal longitudinal tabs (50) of the float (46) allow the float to be attached to the longitudinal rails (14) which have been mentioned in the description of FIG. 1 and to be shown in detail in further drawings.

As can be seen on the drawing, removable float stiffening element (80) is installed inside the float lower part and supported by at least two stiffener element support plates (82) which are attached to the interior of side walls of the float lower part, generally, at the centroid of the side wall of said lower part of said float.

The stiffening element prevents float deformation under water pressure can be designed substantially in horizontal orientation or vertical orientation or as combination of both. As shown on the drawing the float is equipped with the float bottom middle fin (72) and two float bottom side fins (74) with notches (76) for removable attachment of the axle the boat launching wheels (78).

The float removable gasketted cover is installed on the float providing water sealing of the float interior. The float cover gasket sealing configuration being of the usual conventional design, old in the art, and well known in structure and methods of operation to those skilled in the art, it is therefore simply indicated, and the details of structure and operation of it are omitted.

The float configuration consists of two distinctive parts divided by a transition line (67) at which both said parts meet, a lower part designed to be normally in contact with water and upper part designed to be normally above water.

FIG. 3A shows an isometric view detail of the straight configuration of the notch (76) to hold boat launching wheels axle.

FIG. 3B shows an isometric view detail of the T-configuration of the notch (76) to hold boat launching wheels axle.

Figure 4:
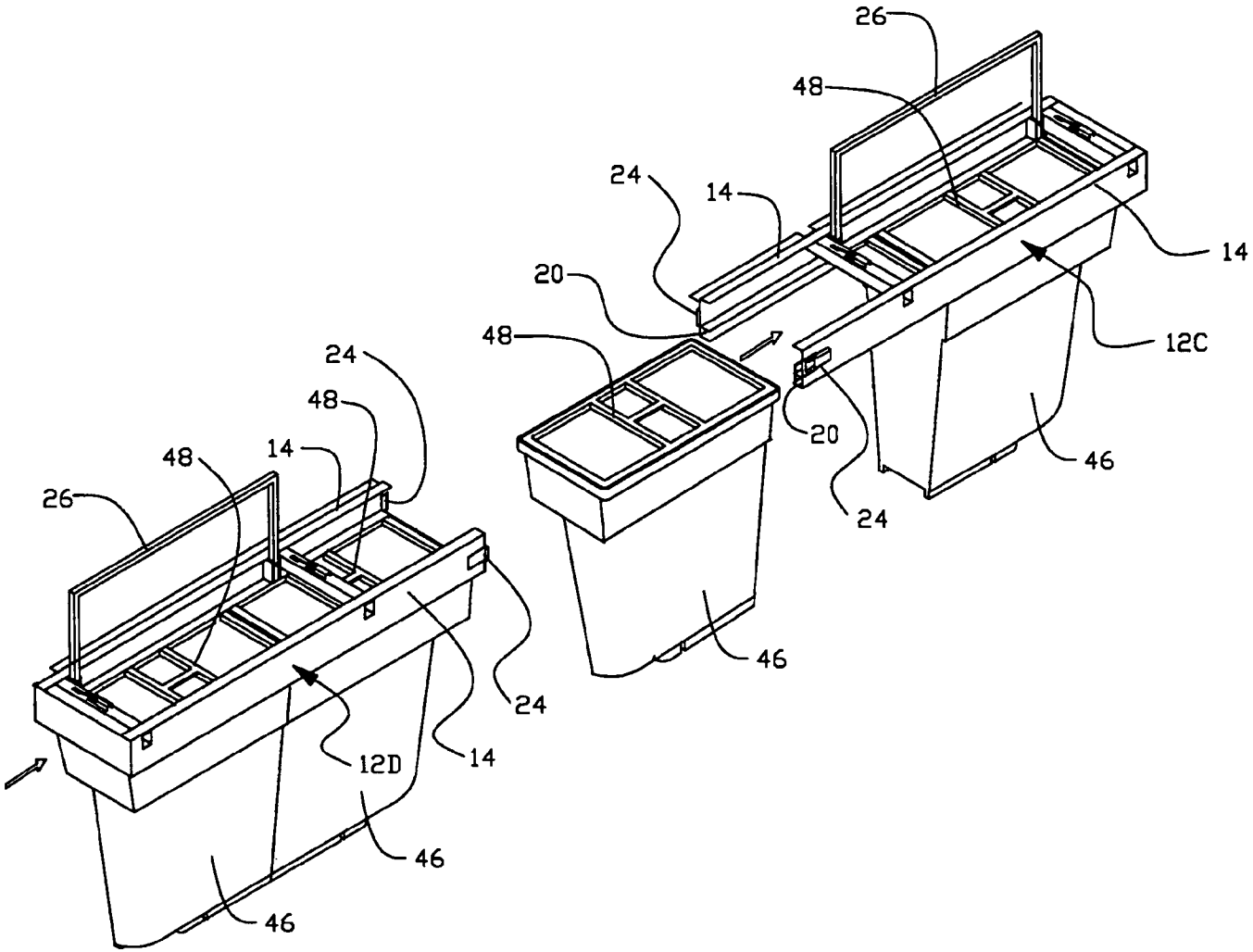
FIG. 4 Shows isometric view of the assembly process for paired installation type floats of one side of the inventive boat frame with two releasable locking means.

FIG. 4 shows an isometric view of the assembly process for pair installed type stackable floats (46). The drawing shows one side of the inventive boat frame (12) with split apart the frame parts (12C) and (12D). The frame releasable locking means (24) have been unlocked allowing the guard rails (26) are brought in the unfolded position and the floats (46) are pushed into the internal longitudinal grooves (20) of the longitudinal rails (14) of the said frame parts (12C) and (12D). The same process is applicable for another side of the boat frame (parts (12A) and (12B).

Figure 5:
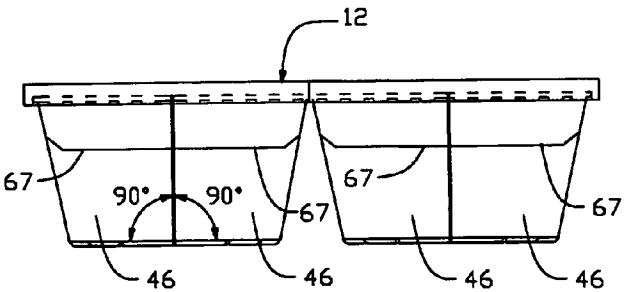
FIG. 5 Shows simplified conceptual side view of two pair float assembly.

FIG. 5 presents simplified conceptual side view of the inventive boat using float pairs style. The diagram emphasizes on 90 degree angle established between bottom wall of the float (46) and the wall contacting another adjacent float.

The float configuration consists of two distinctive parts divided by a transition line (67) at which both said parts meet, a lower part designed to be normally in contact with water and upper part designed to be normally above water.

Figure 6:
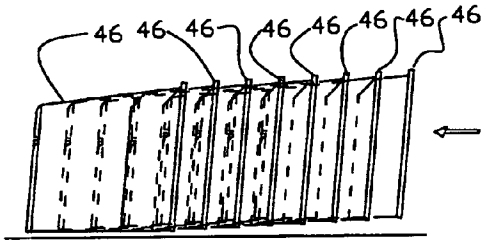
FIG. 6 Shows simplified conceptual side view of stacked floats of paired floats concept.

Referring to FIG. 6 which is simplified conceptual side view of the stacked floats (46) with quantities of the floats required for both sides of the boat frame.

Figure 7:
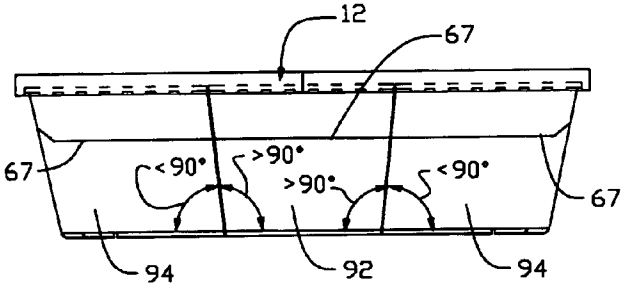
FIG. 7 Shows simplified conceptual side view of one hull assembly comprising one intermediate symmetrical float and two end floats.

Referring to FIG. 7 which is simplified conceptual side view of the inventive boat using the intermediate symmetrical style float (92) and two end floats (94) being installed adjacently to the float (92) at the front and rear direction of the boat (92) with adjacent walls of the floats contacting each other. The diagram emphasizes on the angles established between the bottom wall and contacting walls of the float (92) which shall exceed 90 degrees and shall assume an optimal value depending on the float walls thickness and desired depth of nesting (distance between bottom walls of the stacked floats) to allow stacking of the floats and to construct the floats (92) and (94) to share the same type and size of the float covers to simplify the boat assembling process.

The floats configuration consists of two distinctive parts divided by a transition line (67) at which both said parts meet, a lower part designed to be normally in contact with water and upper part designed to be normally above water.

Both angles are designed to be equal. Exact value of the said above angle can be easily determined using graphic method which is usual and well known to those skilled in the art.

Figure 8:
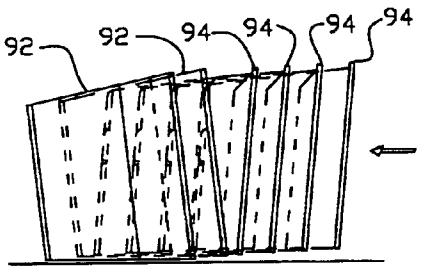
FIG. 8 Shows simplified conceptual view of stacked floats of one continuous pontoon hull concept comprising one intermediate symmetrical float and two end floats.

Referring to FIG. 8 which is simplified conceptual side view of the stacked floats (92) and (94) with quantities of the floats required for both sides of the boat frame.

Figure 9:
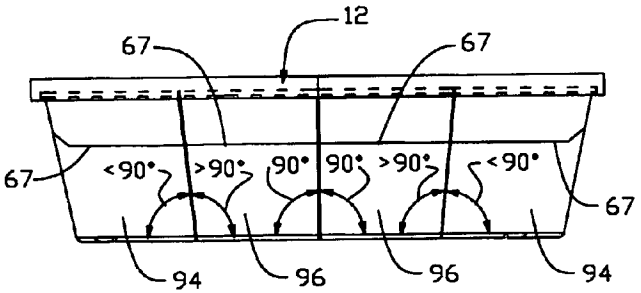
FIG. 9 Shows simplified conceptual side view of one continuous pontoon hull assembly comprising two intermediate asymmetrical floats and two end floats.

Referring to FIG. 9 which is simplified conceptual side view of the inventive boat using the intermediate asymmetrical style floats (96) and two end style floats (94) being installed adjacent to the floats (96) at the front and rear direction of the boat. Adjacent contacting walls of the floats (96) shall establish 90 degrees angles to their respective bottom walls. The diagram emphasizes on the angle established between the bottom wall of the float (96) and the wall adjacent to the wall of float (94) which shall exceed 90 degrees and shall assume an optimal value depending on the float walls thickness and desired depth of nesting (distance between bottom walls of the stacked floats) to allow stacking of the floats and to construct the floats (94) and (96) to share the same type and size of the float covers to simplify the boat assembling process. Exact value of the said above angle can be easily determined using graphic method which is usual and well known to those skilled in the art.

The floats configuration consists of two distinctive parts divided by a transition line (67) at which both said parts meet, a lower part designed to be normally in contact with water and upper part designed to be normally above water.

Figure 10:
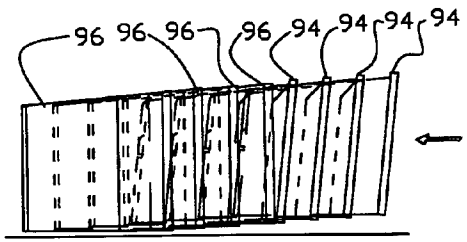
FIG. 10 Shows simplified conceptual view of stacked floats of one continuous pontoon hull concept comprising two intermediate asymmetrical floats and two end floats.

Referring to FIG. 10 which is simplified conceptual side view of the stacked end style floats (94) and intermediate asymmetrical style floats (96) with quantities of the floats required for the boat.

Figure 11:
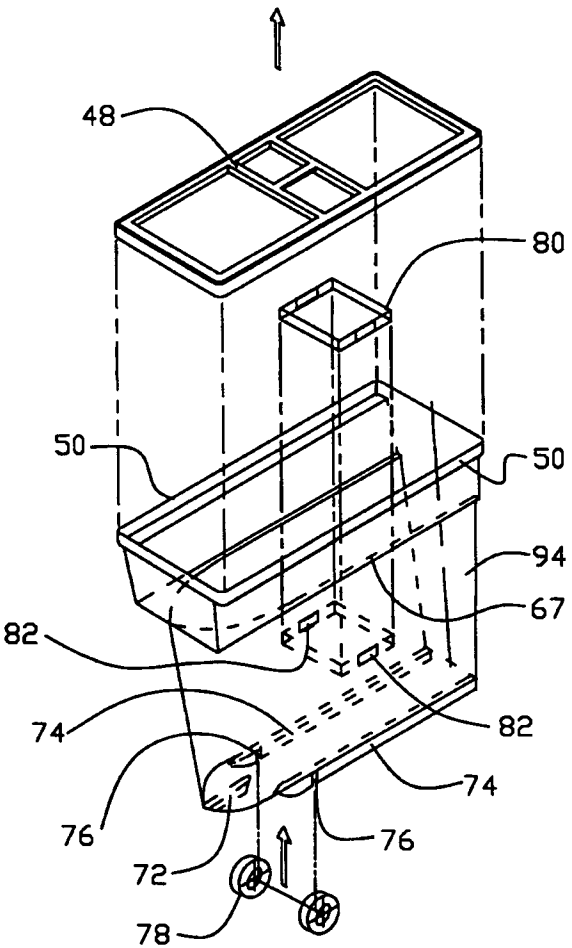
FIG. 11 Shows isometric view of the end float of one continuous pontoon hull concept comprising one intermediate symmetrical float and two end floats.

Referring to FIG. 11 which is an isometric view of the end style float (94) comprising the float bottom middle fin (72), two float bottom side fins (74) with the notches (76) in each of them. The float removable and stackable gasketted cover (48) and removable stiffening element (80) have been lifted out of the float, and the stiffening element support plates (82) are attached to the interior of side walls of the lower part of the float and located generally at the centroid of the each side wall of said lower part of said float.

Horizontal longitudinal tabs (50) of the float (94) allow the float to be attached to the longitudinal rails (14) which have been mentioned in the description of FIG. 4 and to be shown in detail in further drawings.

The float configuration consists of two distinctive parts divided by a transition line (67) at which both said parts meet, a lower part designed to be normally in contact with water and upper part designed to be normally above water.

Figure 12:
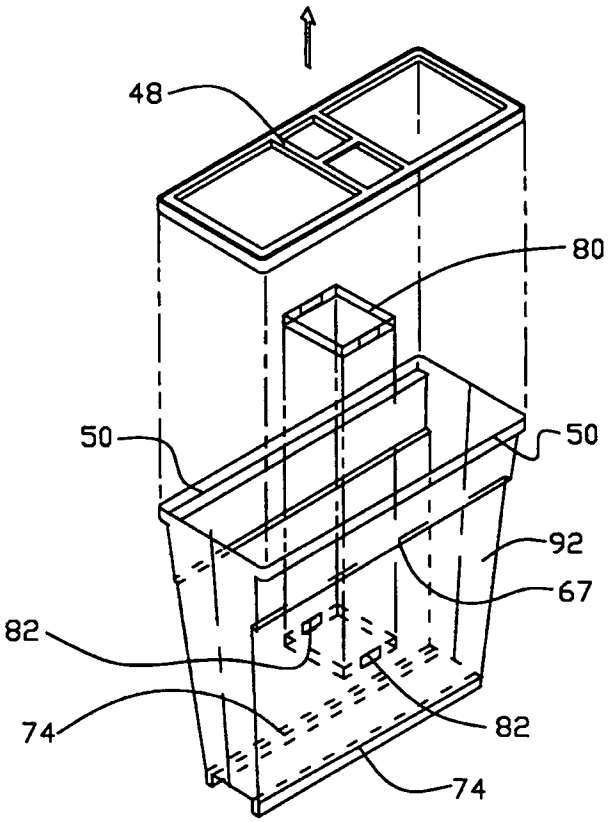
FIG. 12 Shows isometric view of the intermediate symmetrical float of one continuous pontoon hull concept comprising one intermediate symmetrical float and two end floats.

Referring to FIG. 12 which is an isometric view of the intermediate symmetrical style float (92) comprising two float bottom side fins (74) which in this case are continuous through all length of the float bottom and with the notches (76) in each of them. The float removable and stackable gasketted cover (48) and removable stiffening element (80) have been lifted out of the float, and the stiffening element support plates (82) are attached to the interior of side walls of the lower part of the float and located generally at the centroid of the each side wall of the lower part of said float.

Horizontal longitudinal tabs (50) of the float (92) allow the float to be attached to the longitudinal rails (14) which have been mentioned in the description of FIG. 4 and to be shown in detail in further drawings.

The floats configuration consists of two distinctive parts divided by a transition line (67) at which both said parts meet, a lower part designed to be normally in contact with water and upper part designed to be normally above water.

Figure 13:
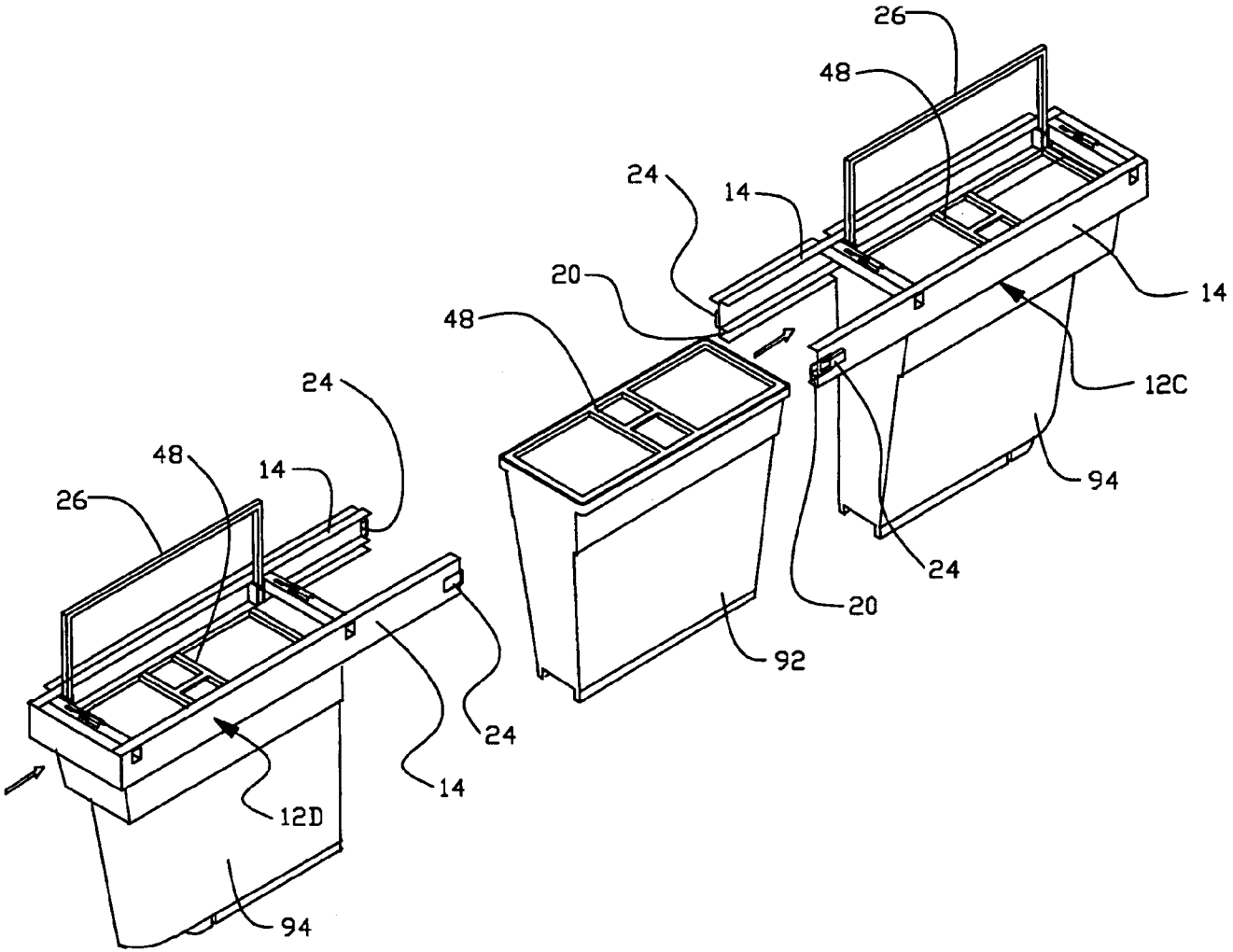
FIG. 13 Shows isometric view of the assembly process one continuous pontoon hull concept comprising one intermediate symmetrical float and two end floats of one side of the inventive boat frame with two releasable locking means.

FIG. 13 shows an isometric view of the assembly process for the floats assembled in one hull concept comprising symmetrical style intermediate float (92) and two end style floats (94). The drawing shows one side of the inventive boat frame (12) with split apart the frame parts (12C) and (12D). The frame releasable locking means (24) have been unlocked allowing the frame to split. The swivelly foldable guard rails (26) are brought in the unfolded position and the floats (92) and (94) are pushed into the internal longitudinal grooves (20) of the longitudinal rails (14) of the said frame parts (12C) and (12D). The same process is applicable for another side of the boat frame (parts (12A) and (12B).

Figure 14:
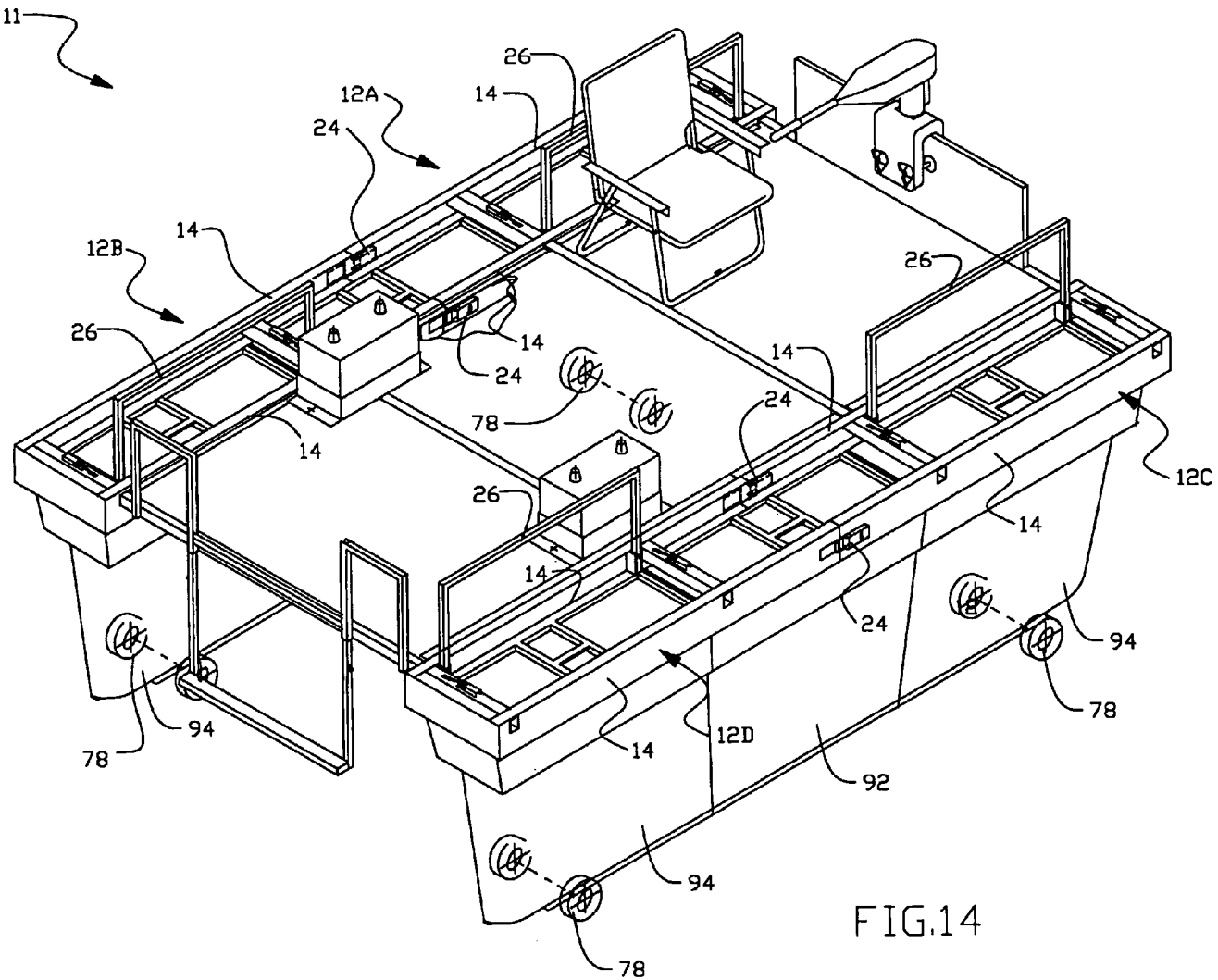
FIG. 14 Shows isometric view of the inventive boat with floats assembled in one continuous pontoon hull concept comprising one intermediate symmetrical float and two end floats.

Referring to FIG. 14 which is an isometric view of the inventive boat with floats assembled in one hull concept comprising symmetrical style intermediate floats (92) and end style floats (94). The boat foldable horizontal frame section (12A) is connected to the foldable horizontal frame section (12B) by the releasable locking means (24), and the foldable horizontal frame section (12C) is connected to the foldable horizontal frame section (12D) by the same type locking means. The boat launching wheels with axle (78) are shown attached to the end style floats.

Figure 15:
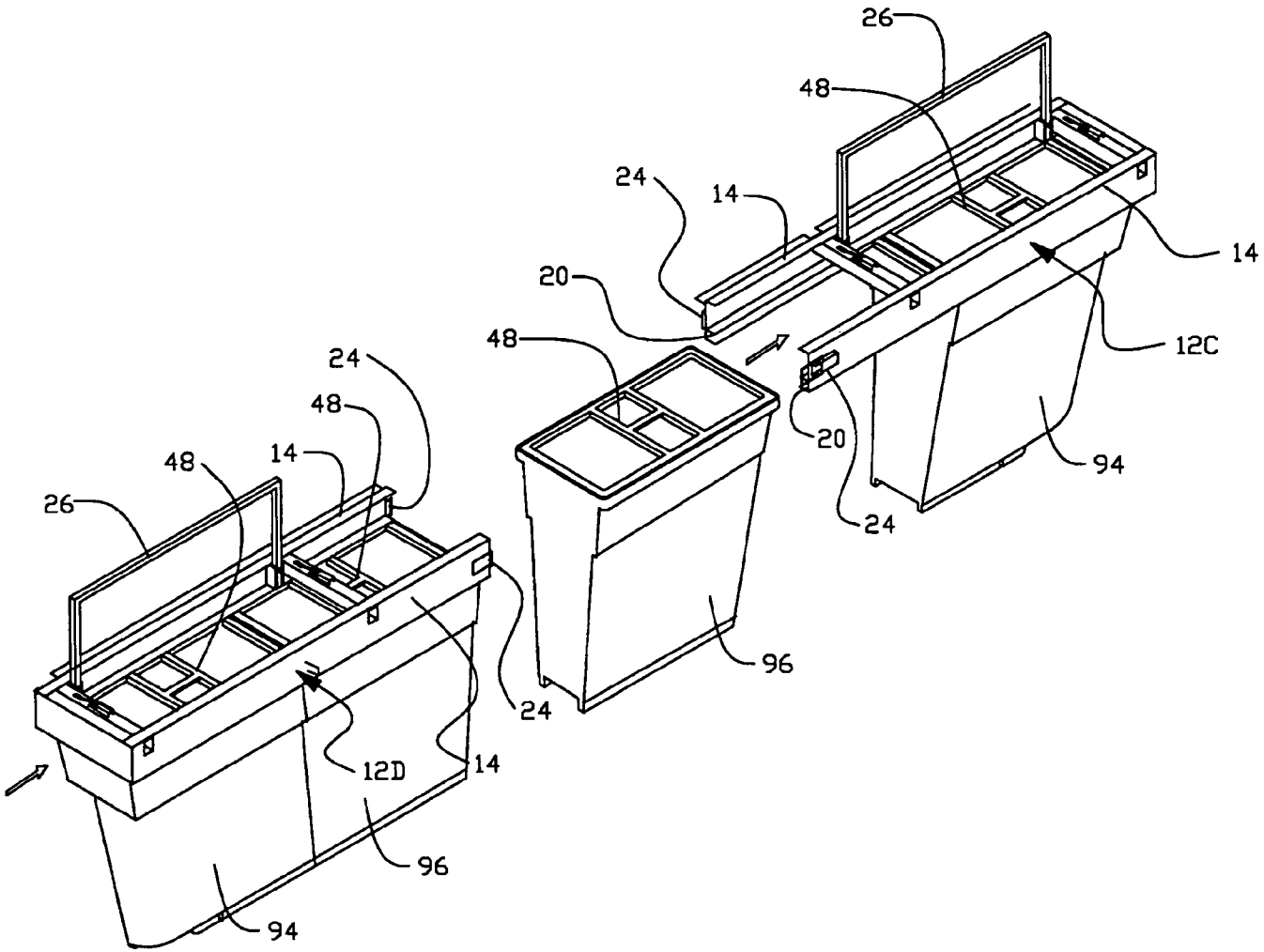
FIG. 15 Shows isometric view of the assembly process one continuous pontoon hull concept comprising two intermediate asymmetrical floats and two end floats of one side of the inventive boat frame with two releasable locking means.

FIG. 15 shows an isometric view of the assembly process for the floats assembled in one hull concept comprising two asymmetrical style intermediate floats (96) and two end style floats (94). The drawing shows one side of the inventive boat frame (12) with split apart the frame parts (12C) and (12D). The game releasable locking means (24) have been unlocked allowing the frame to split apart. The swivelly foldable guard rails (26) are brought in the unfolded position and the floats (96) and (94) are pushed into the internal longitudinal grooves (20) of the longitudinal rails (14) of the said frame parts (12C) and (12D). The same process is applicable for another side of the boat frame (parts (12A) and (12B).

Figure 16:
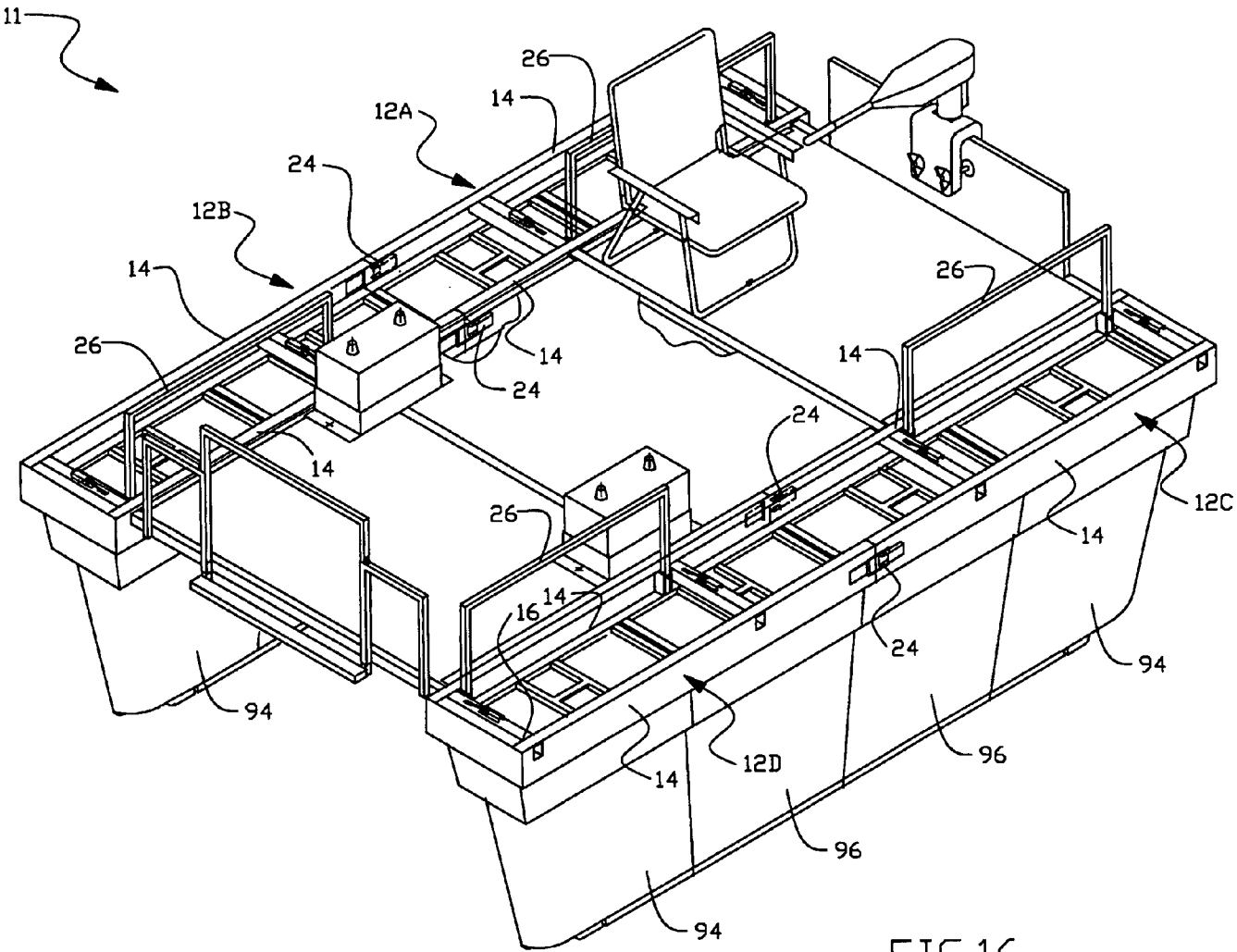
FIG. 16 Shows isometric view of the inventive boat with floats assembled in one continuous pontoon hull concept comprising two intermediate symmetrical intermediate floats and two end floats.

Referring to FIG. 16 which is an isometric view of the inventive boat with floats assembled in one hull concept comprising intermediate asymmetrical style floats (96) and end style floats (94). The boat foldable horizontal frame section (12A) is connected means (24), and the foldable horizontal frame section (12C) is connected to the foldable horizontal frame section (12D) by the same type locking means.

Figure 17:
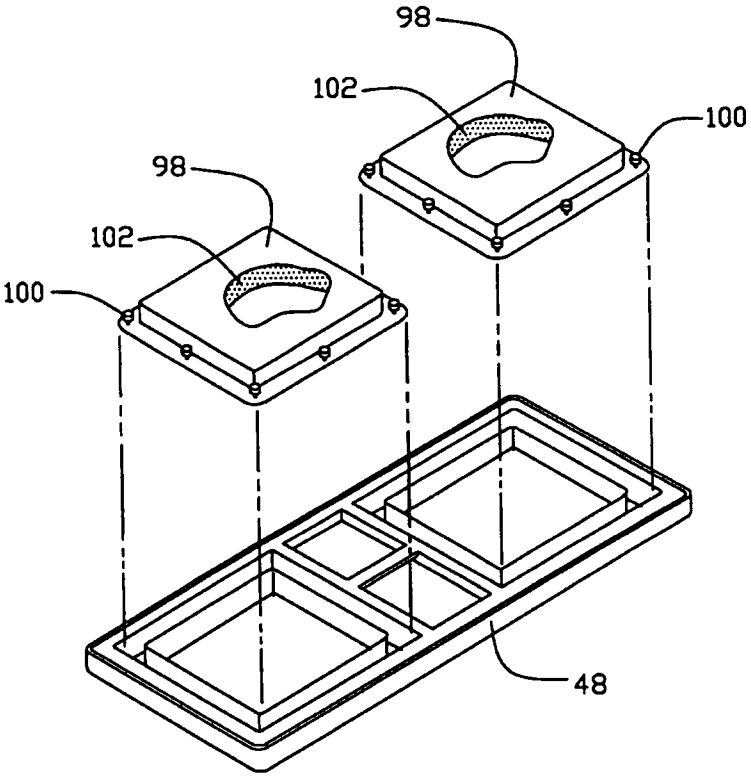
FIG. 17 Shows isometric view of the float cover with two access hatches.

FIG. 17 shows an isometric view of the float cover (48) with the cover watertight gasketted access hatches (98) has been removed from the float cover after releasing the hatch releasable locking means (100). The hatches can be filled with a plastic foam (102) for redundant flotation. The access hatch gasket sealing configuration and releasable locking means being of the usual conventional design, old in the art, and well known in structure and methods of operation to those skilled in the art, it is therefore simply indicated, and the details of structure and operation of it are Omitted.

Figure 18:
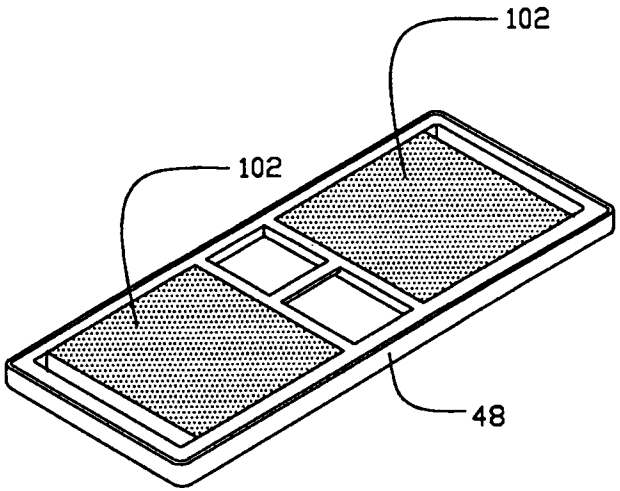
FIG. 18 Shows isometric view of the float cover with redundant flotation plastic foam fill.

FIG. 18 shows an isometric view of the float cover (48) with a plastic foam (102) for redundant flotation. However, the float cover can be constructed with air pockets, which being of the usual conventional design, old in the art, and well known in structure and methods of operation to those skilled in the art, it is therefore simply indicated, and the details of structure and operation of it are omitted.

Figure 19:
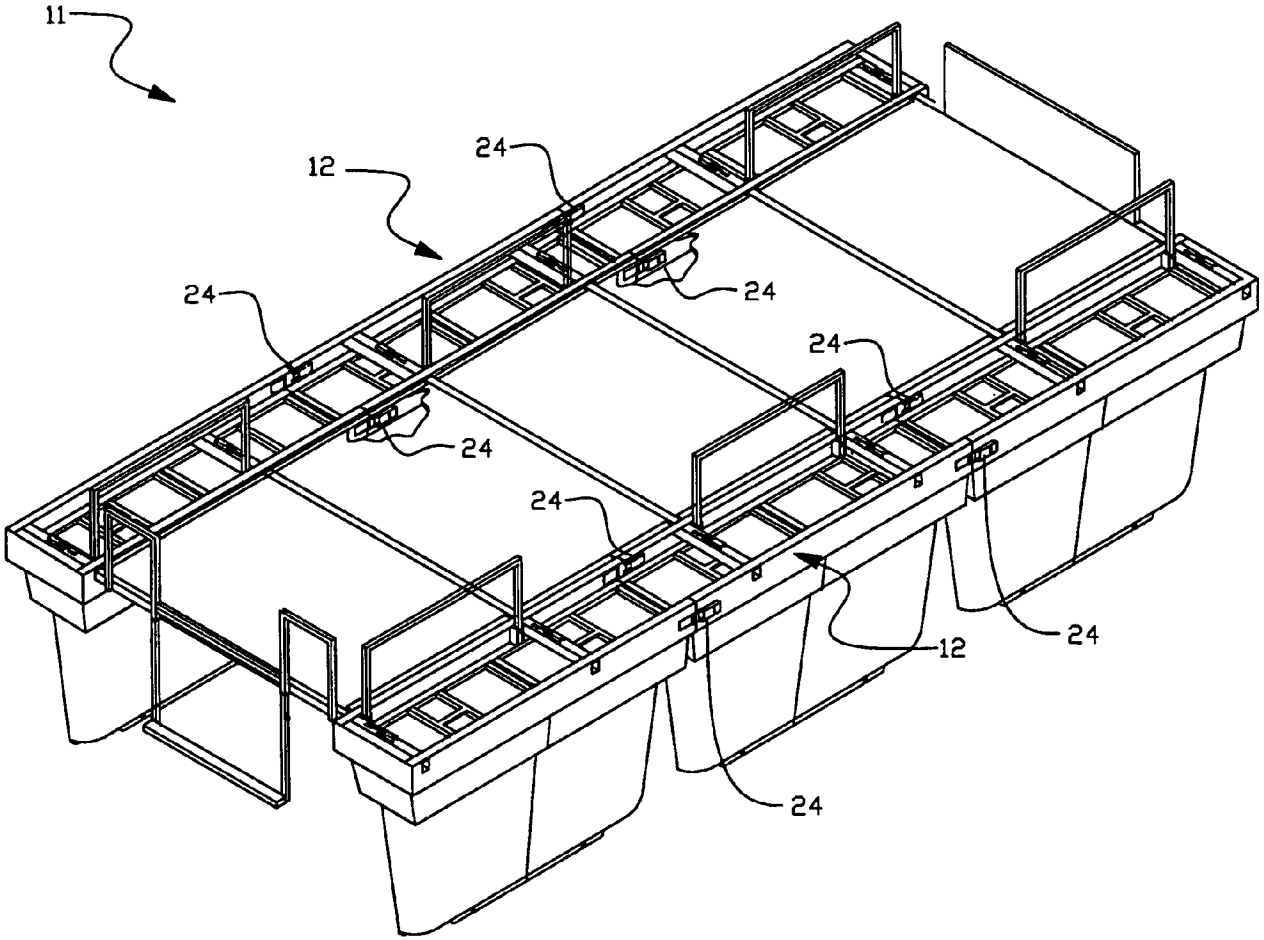
FIG. 19 Shows isometric view of the inventive boat with the foldable horizontal frame having more than two connections on each side.

FIG. 19 shows an isometric view of the inventive boat (11) with more than two connected sections on each side of the foldable horizontal frame (12) secured by the releasable locking means (24).

I claim:

1. An improved folding boat with at least two foldable horizontal frames each comprising at least two foldably connected sections attached to each other by a transverse swivel joint on one side and by releasable locking means on another side, where said foldably connected sections comprise two substantially parallel longitudinal rails connected by a plurality of transverse members and at least one swivelly foldable guard rail with releasable locking means, further, said longitudinal rails comprise internal and external longitudinal groves, where said internal longitudinal grooves hold a plurality of removable and stackable floats each equipped with a removable and stackable gasketed cover and horizontal longitudinal tabs, where each said float comprises a substantially flat and vertical wall allowing said floats to be installed in pairs with mirror orientation to each other with their said flat and vertical walls contacting each other, so each pair of said floats forms a hydrodynamically shaped hull, and further, said foldable horizontal frames are connected by a plurality of removable horizontal transverse beams are secured to said transverse members of said foldable horizontal frames by beams releasable locking means, where said horizontal transverse beams comprise longitudinal tabs, so, longitudinal edges of removable deck sheets of the boat are held in place and supported by said external longitudinal grooves of said longitudinal rails and transverse edges of the same deck sheets are supported by said longitudinal tabs of said transverse horizontal beams, so, in the boat folding process said beams releasable locking means can be released allowing detachment of said horizontal transverse beams and deck sheets from the boat, and further, said foldably connected sections of said foldable horizontal frames can be swivelably folded with prior release of their said releasable locking means allowing removal of said removable and stackable floats from said internal grooves of said longitudinal rails of said sections of said foldable horizontal frames and further, said swivelably foldable guard rails can be swivelably folded with prior release of said guard rail releasable locking means, so said swivelably foldable guard rails assume folded position substantially coplanar with top surface of said sections of said foldable horizontal frames wherein the improvement comprises:

said removable and stackable floats are designed in two configurations, where one configuration of said floats is identified as intermediate asymmetrical style and another configuration of said floats identified as end style, so, two said end style floats and two said intermediate asymmetrical floats being installed between them form one continuous pontoon hull on the each side of said boat, further, each said float is equipped with at least one removable float stiffening element installed inside said float lower part to prevent deformation of the float side walls under pressure of water and said float covers being identical in shape and size are interchangeable between said floats, additionally, one of horizontal transverse beams connecting said foldable horizontal frames and located at the front of the boat has two front guard rails equipped with a guiding channels supporting a slidable frame of climbing step, where said frame is slidably movable between upper, retracted, position in which being held by a releasable locking means assumes function as a middle section of the front guard rail and upon release of said releasable locking means, said frame being moved to lower position provides convenient position of the climbing step for climbing to the level of said deck sheets of the inventive boat, wherein said removable and stackable floats, equipped with at least one removable float stiffening element installed inside said float lower part, are constructed as paired installation style floats with mirror orientation and equipped with a middle fin and two side fins attached to the float bottom wall and said each side fin is equipped with a notch that holds boat launching wheels axle and to allow said launching wheels with axle to drop off when said boat is on the water.

2. The folding boat of claim 1 where said removable and stackable floats each, equipped with at least one removable float stiffening element installed inside said float lower part, are constructed in other two configurations, where one configuration of said floats is identified as intermediate symmetrical style and another configuration of said floats identified as end style when two said end style floats and one said intermediate symmetrical float being installed between them to form one continuous pontoon hull on the each side of the inventive boat.

3. The folding boat of claim 1 or 2 where said in intermediate asymmetrical and symmetrical styles of floats and end style floats are equipped with bottom side fins, in addition to that, said each end style float is equipped with bottom middle fin and said bottom side fins of said floats are equipped with notches to hold boat launching wheels axle and to allow said launching wheels with axle to drop off when the inventive boat is on the water.

4. The folding boat of claim 1 where said removable and stackable gasketted covers of the floats are equipped with at least one watertight gasketted access hatch secured to said cover by releasable locking means allowing removal of said gasketted covers without tools.

5. The folding boat of claim 1 where said inventive boat is provided with redundant floatation capability by using plastic foam or air pockets in structural elements of the boat including longitudinal rails, transverse members foldable horizontal frames, removable horizontal transverse beams, transom plate, guard rails, slidable climbing step frame, removable deck sheets, the boat floats and covers of said floats.

* * * * *